US010149499B2

(12) United States Patent
Sklar

(10) Patent No.: US 10,149,499 B2
(45) Date of Patent: Dec. 11, 2018

(54) UNDERWEAR INCLUDING INTEGRAL POCKETS

(71) Applicant: Oscar Sklar, Hollywood, CA (US)

(72) Inventor: Oscar Sklar, Hollywood, CA (US)

( * ) Notice: Subject to any disclaimer, the term of this patent is extended or adjusted under 35 U.S.C. 154(b) by 212 days.

(21) Appl. No.: 15/190,371

(22) Filed: Jun. 23, 2016

(65) Prior Publication Data

US 2016/0374403 A1 Dec. 29, 2016

Related U.S. Application Data

(60) Provisional application No. 62/183,777, filed on Jun. 24, 2015.

(51) Int. Cl.
*A41B 9/02* (2006.01)
*A41D 27/20* (2006.01)

(52) U.S. Cl.
CPC ..... *A41B 9/02* (2013.01); *A41D 27/20* (2013.01)

(58) Field of Classification Search
CPC ..... A41B 9/02; A41D 1/08
See application file for complete search history.

(56) References Cited

U.S. PATENT DOCUMENTS

D116,817 S 9/1939 Dietz
2,495,863 A * 1/1950 Paige ..... A41B 9/02 2/231
3,137,862 A 6/1964 Mizerak
D283,077 S 3/1986 Crandall
5,093,935 A 3/1992 Countee, Jr.
5,172,430 A 12/1992 Lerma-Solis
D339,219 S 9/1993 Beauchemin
5,255,392 A 10/1993 Stanislaw
5,561,865 A 10/1996 Fjelstul
5,718,003 A 2/1998 Gwinn
5,822,793 A * 10/1998 Tokura ..... A41B 13/00 2/227
5,920,914 A 7/1999 Dempsey
6,076,195 A 6/2000 Klein
7,032,249 B2 4/2006 Smith
D664,326 S 7/2012 Steele
D771,072 S 11/2016 Protzman et al.
2004/0083538 A1 5/2004 Thomas
2004/0255367 A1 12/2004 Harris
2005/0150032 A1 7/2005 Bartle
2008/0189832 A1 8/2008 Oscher
2012/0311758 A1 12/2012 Nicholson et al.
2016/0037843 A1 2/2016 Cook
2017/0135875 A1* 5/2017 Johnson ..... A41B 9/02

FOREIGN PATENT DOCUMENTS

WO WO 2005/046369 5/2005

OTHER PUBLICATIONS https://www.google.com/search?q=men%27s+underwear+with+stash+pocket&safe=off&biw=1280&bih=633&source=lnms&tbm=isch&sa=X&ved=0ahUKEwiv5vTh3pTNAhVq7IMKHQVvBMcQ_AUIBygC.
http://www.danieal.com/.

* cited by examiner

*Primary Examiner* — Tejash Patel
(74) *Attorney, Agent, or Firm* — Robert M. Schwartz; Alfred K. Dassla

(57) ABSTRACT

Pocketed undergarments including one or more pockets are disclosed. The one or more pockets are affixed to a crotch area of an undergarment while allowing a male member to protrude through the undergarment.

20 Claims, 5 Drawing Sheets

UNDERWEAR INCLUDING INTEGRAL POCKETS

CROSS REFERENCE TO RELATED APPLICATIONS

This application claims benefit of U.S. Provisional Patent Application. No. 62/183,777 filed Jun. 24, 2015, entitled Underwear Including Integral Pockets, the disclosure of which is incorporated herein by reference in its entirety.

BACKGROUND OF THE INVENTION

It is common for garments to have pockets. For example, pants generally are provided with pockets to store items such as wallets or mobile phones.

However, commonly provided garment pockets are publicly visible, and thus may be pickpocketed or exposed to pat-downs which compromise the security or privacy of items stored in such common pockets.

Patents exist that attempt to solve this problem by providing pockets on underwear. However, such patents either disclose pockets located on non-crotch areas of undergarments, or in a crotch area that prevents a male from accessing or exposing their male organ. A filled pocket located on a non-crotch area will cause an unnatural bulge on the non-crotch area, revealing hidden items in the pocket. A crotch-blocking pocket that blocks frontal access to the male organ through a frontal face of underwear inconveniently requires a male to expose the male organ above the waist band by pulling down the waist band or an entire unit of the underwear, or through bizarre paths such as through a thigh interface of the underwear.

As such, there exists a need for improved underwear that can more conveniently and secretly hide items while allowing a user to expose their male organ through a frontal crotch face of underwear.

BRIEF SUMMARY OF THE INVENTION

Disclosed is an undergarment comprising, an elastic waistband, two leg portions attached to said elastic waistband, a crotch area connecting said two leg portions to one another, said crotch area having an opening defining a passageway for allowing a male organ to pass through and protrude from said undergarment, and a double-walled pocket affixed externally at said crotch area, said double-walled pocket covering said opening.

In another aspect, said double-walled pocket has lateral sides that are affixed along lateral edges of said opening.

In another aspect, said double-walled pocket has an inner wall, a top of said inner wall being affixed along a portion of said waistband.

In another aspect, said opening has a bottom edge, said double-walled pocket overlapping said bottom edge.

In another aspect, said bottom edge is elastic.

In another aspect, said double-walled pocket has an outer wall, said outer wall being continuous with a bottom of said inner wall.

In another aspect, said double-walled pocket has an outer wall, a top of said outer wall being detachably securable to a top of said inner wall.

In another aspect, said double-walled pocket has an open top and a closed bottom and closed sides to receive and store items.

In another embodiment, disclosed is an undergarment comprising, an elastic waistband two leg portions attached to said elastic waistband a crotch area connecting said two leg portions to one another, said crotch area having an opening defining a passageway for allowing a male organ to pass through and protrude from said undergarment, and a first and a second double-walled pocket affixed externally at said crotch area allowing said male organ to pass through between said pockets.

In another aspect, each pocket has an outer lateral side that is affixed along a lateral edge of said opening.

In another aspect, each pocket has an inner wall, a top of said inner wall being affixed along a portion of said waistband, for each pocket respectively.

In another aspect, said opening has a bottom edge, each pocket being affixed along a portion of said bottom edge, for each pocket respectively.

In another aspect, each pocket has an outer wall, said outer wall being continuous with a medial side of said inner wall, for each pocket respectively.

In another aspect, each double-walled pocket has an outer wall, a top of said outer wall being detachably securable to a top of said inner wall, for each pocket respectively.

In another aspect, each double walled pocket has an open top and a closed bottom and closed sides to receive and store items.

In yet another embodiment, disclosed is an undergarment comprising, an elastic waistband, two leg portions attached to said elastic waistband, a crotch area connecting said two leg portions to one another, said crotch area having an opening defining a passageway for allowing a male organ to pass through and protrude from said undergarment, a first and a second double-walled pocket affixed externally at said crotch area allowing said male organ to pass through between medial surfaces of said pockets, each pocket having an inner wall, a top of said inner wall being affixed along a portion of said waistband, for each pocket respectively, each pocket having an outer wall, outer lateral sides of said inner wall and outer wall being together affixed along lateral edges of said opening, for each pocket respectively, said opening having a bottom edge, a bottom of said inner and outer wall being together affixed along a portion of said bottom edge, for each pocket respectively, and said outer wall being continuous and integrally formed with said inner wall through said medial surfaces, for each pocket respectively.

In another aspect a top of said outer wall is detachably securable to a top of said inner wall, for each pocket respectively.

In another aspect, said together affixed portions of said inner and outer wall cause said pocket to have a closed bottom and closed sides to hold and store items.

In another aspect, said inner and outer walls of said pockets are together stitchably affixed at said lateral edges of said opening and at said bottom edge of said opening, for each pocket respectively.

In another aspect, a top of said outer wall is detachably securable to a top of said inner wall via hook and loop fasteners.

DETAILED DESCRIPTION OF THE INVENTION

Figure 1:
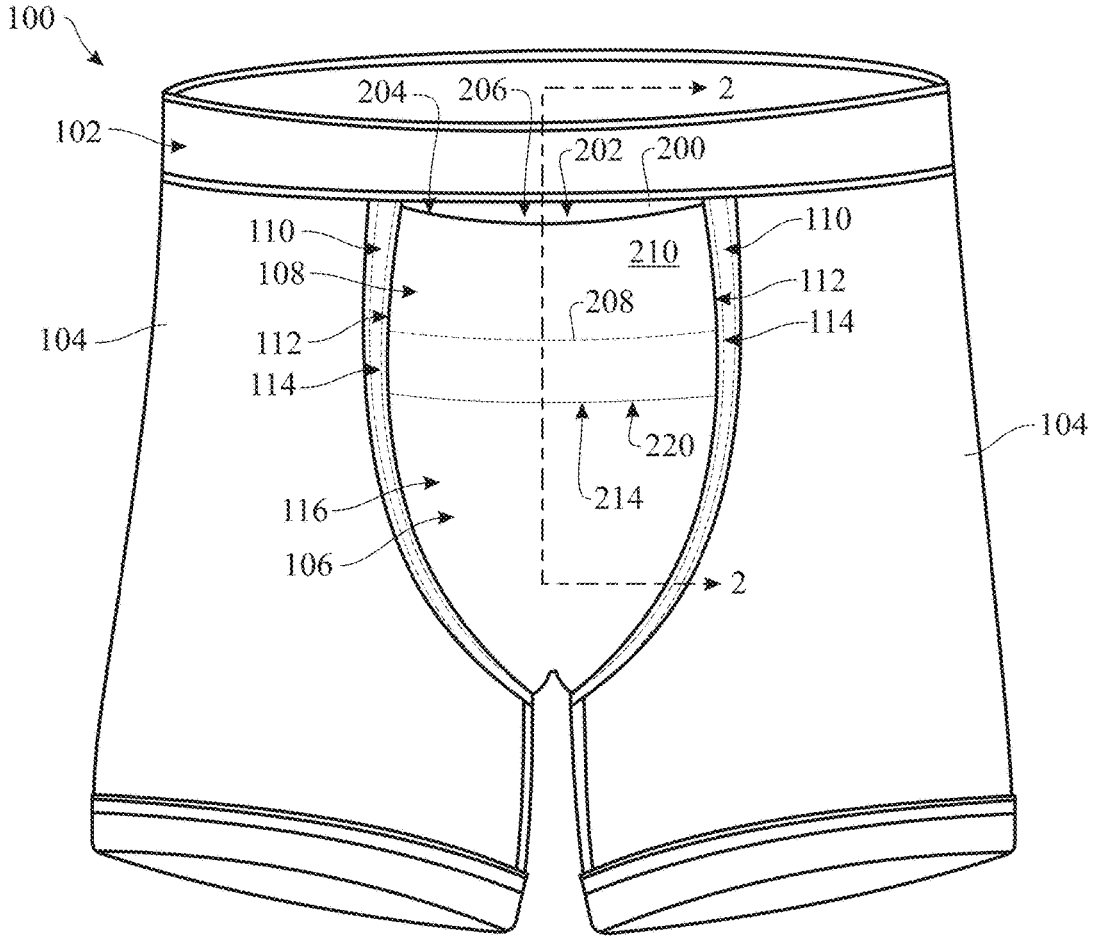
FIG. 1 presents a front view of a pocketed undergarment.

The illustration of FIG. 1 shows a front view of a pocketed undergarment 100 that includes an elastic waistband 102, leg portions 104, a crotch area 106, and an opening 222 in the crotch area 106.

The undergarment 100 may generally resemble underwear such as common briefs or boxer briefs. The leg portions 104 may be attached to the elastic waistband 102 and each leg portion may define a passageway for receiving, a human leg of a wearer. The waistband 102 may be inelastic in some embodiments.

The crotch area 106 connects the two leg portions 104 to one another. The crotch area 106 is a region between the leg portions 104 and the waistband 102. The opening 222 may be disposed in the crotch area 106. For example, the crotch area 106 may be or may include a sheet of fabric, or an affixed flap, which includes or defines the opening 222. The opening 222 may be an empty region between a lower crotch material 116 and the waistband 102. The lower crotch material 116 may extend between the leg portions 104 and may be below the opening 222. The opening 222 defines a passageway for allowing a male organ to pass through and protrude from the undergarment 100. For example, a male organ of a wearer may pass through the opening 222 to urinate while the wearer wears the undergarment 100. The opening 222 may have a width and a height.

The undergarment 100 includes a double-walled pocket 108 that is affixed externally at the crotch area 106. For example, the pocket 108 may cover the opening 222. The pocket may have a width and a height. The width and the height of the pocket 108 may cause the pocket 108 to have a frontal surface area that is greater than or equal to a size of the opening 222. The pocket 108 extends from the waistband 102 downward below the opening 222 to cover the opening. The pocket 108 may have lateral sides 110 that are affixed along lateral edges 112 of the opening 222. For example, the lateral edges 112 may define a width of the opening 222. The pocket 108 may be affixed along the lateral edges 112 via stitching 114 or other known adhesive methods such as by glue.

Figure 2:
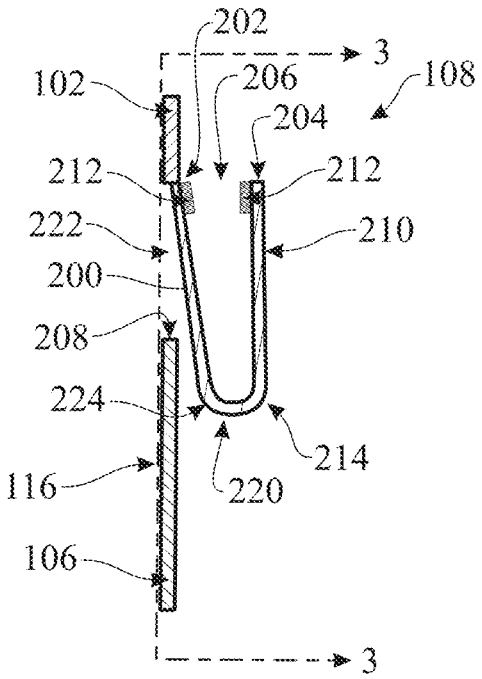
FIG. 2 presents a sectional view of pocket, the section taken along sectional line 2-2 of FIG. 1.
Figure 3:
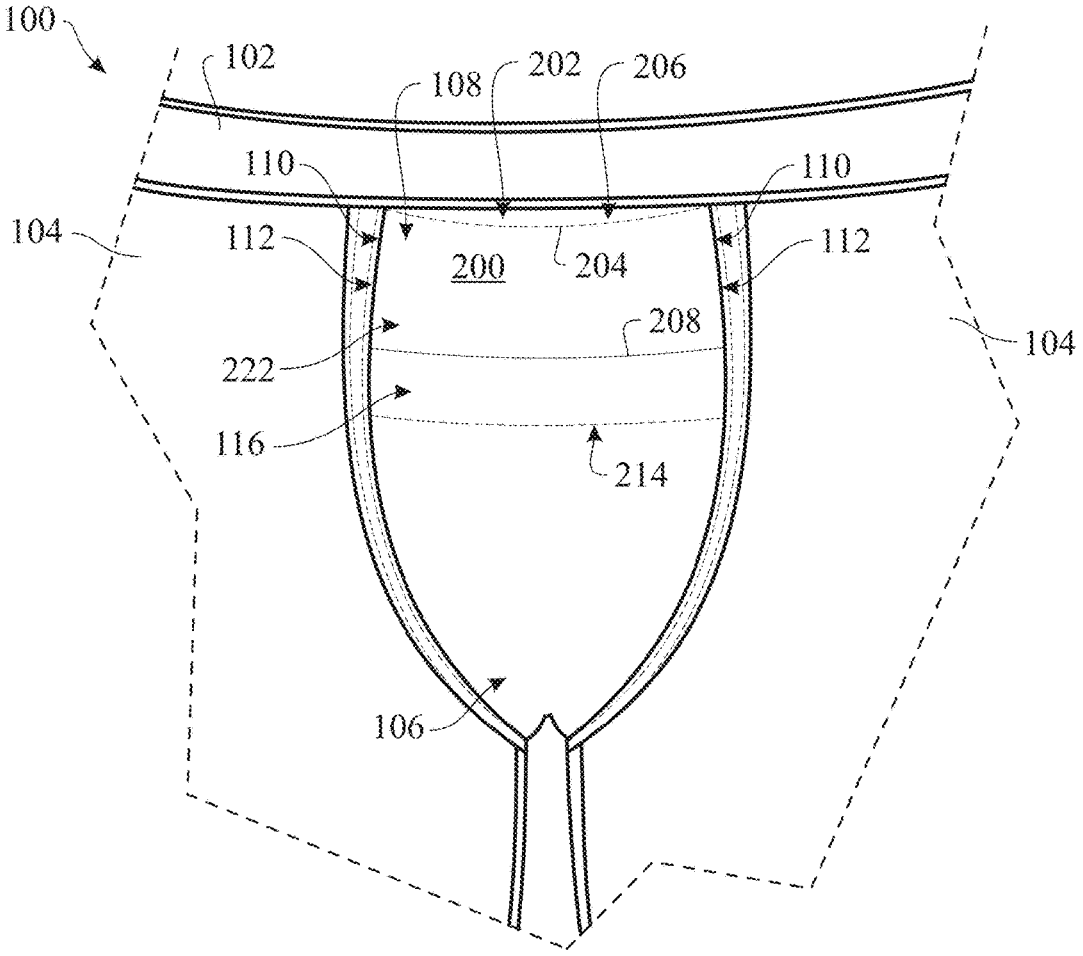
FIG. 3 presents a partial view of an inside of the undergarment looking out, the partial view taken from sectional line 3-3 in FIG. 2.

Turning to FIG. 2, the pocket 108 has an inner wall 200. For example, a top 202 of the inner wall 200 may be affixed along a portion of the waistband 102. For example, the inner wall 200 may be affixed to the waistband 102 via stitching (not being visible in the figures). The opening 222 may have a bottom edge 208 and the pocket 108 may overlap the bottom edge 208. As shown in FIG. 1, the bottom edge 208 is shown in dashed line behind the pocket 108, where the pocket 108 overlaps the bottom edge 208 and a closed bottom 214 of the pocket 108 hangs below the bottom edge 208. From a perspective looking outward from inside the undergarment 100, FIG. 3 shows the bottom edge 208 in solid line above the closed bottom 214, the closed bottom 214 shown in dashed line hanging below and behind the bottom edge 208. The bottom edge 208 may be elastic.

The pocket 108 may include an outer wall 210. The outer wall 210 may be continuous with a bottom 224 of the inner wall 200 as shown in FIG. 2 at fold 220. For example, the outer wall 210 and the inner wall 200 may be continuously integral with one another as part of a single piece of fabric that is folded at fold 220. A top 204 of the outer wall 210 may be detachably securable to a top 202 of the inner wall 200. For example, the top 204 of the outer wall 210 may be detachably securable to the top 202 of the inner wall 200 via fasteners 212 as shown in FIG. 2. For example, the fasteners 212 may be buttons or hook and loop fasteners. In an open state where the outer wall 210 is detached from the inner wall 200, a space between the top 204 of the outer wall 210 and the top 202 of the inner wall 200 may receive items. As such, the pocket 108 may have an openable or open top 206 and the closed bottom 214 and closed sides 110 (FIG. 1) to receive and hold or store items. Received items may be secured by securing the fasteners 212 to each other.

It is to be understood that the height of the opening 222 may be defined by a distance between the elastic band 102 and the bottom edge 208. The bottom edge 208 may be a top edge of the lower crotch material 116 of the crotch area 106. The width of the opening 222 may be defined by a distance between the lateral edges 112. For example, the lateral edges 112 may extend along inner opposing portions of the leg portions 104.

In some embodiments, an upper crotch material (not shown) similar in structure to lower crotch material 116 may be affixed along the elastic band 102 and along opposing inner lateral edges of upper areas of the leg portions 104 such that the opening 222 may be located between such upper crotch material and the lower crotch material 116 or bottom edge 208. As such a height of the opening 222 may be defined by a distance between a lower edge of such upper crotch material (hot shown) and a top edge (e.g. bottom edge 208) of lower crotch material 116.

It is to be understood that the height of the pocket 108 may be defined by a distance between the top 202 of the inner wall 200 and the bottom 224 of the inner wall 200, the fold 220, or the closed bottom 214. Alternatively, the height of the pocket 108 may be defined by a distance between the top 204 of the outer wall 210 and the bottom 224 of the inner wall 200, the fold 220, or the closed bottom 214. The width of the pocket 108 may be defined by a distance between opposing lateral sides 110 of the pocket 108. For example, the width of the pocket 108 may be defined by a distance between portions of the lateral sides 110 of the pocket 108 that are affixed to the undergarment 100 or the leg portions 104. The height and/or width of the pocket 108 may be greater than or equal to the height and/or width of the opening 222 respectively.

Figure 4:
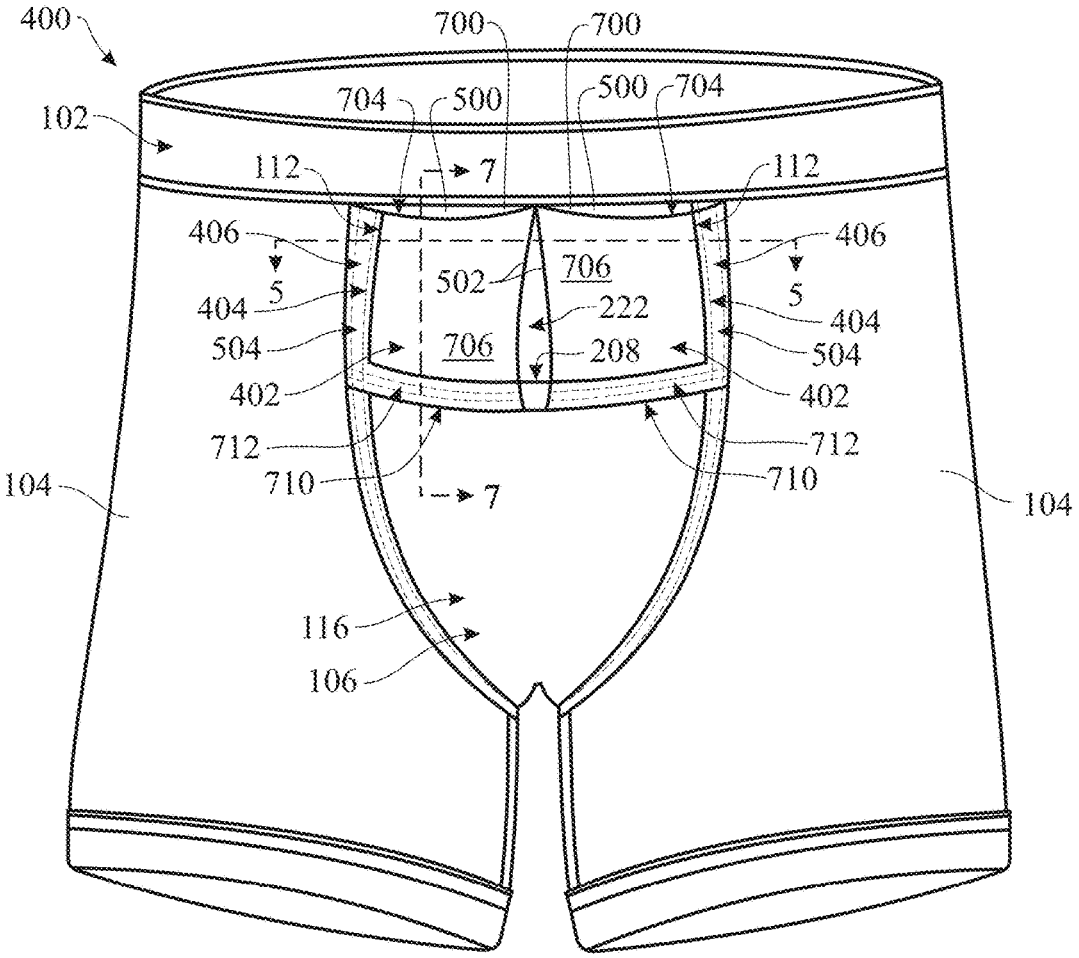
FIG. 4 presents a front view of a pocketed undergarment including two pockets.

FIG. 4 shows another embodiment where an undergarment 400 includes at least two double-walled pockets 402 that are each affixed externally to crotch area 106 allowing a male organ of a wearer to pass through opening 222 and through between the pockets 402. For example, the male organ may pass through between medial sides 502 of the pockets 402 to protrude from the undergarment 400. The pockets 402 may each have an outer lateral side 504 that is affixed along a lateral edge 112 of the opening 222 for each pocket 402, respectively. For example, the pockets 402 may be affixed along lateral edge 112 via stitching 404.

Figure 5:
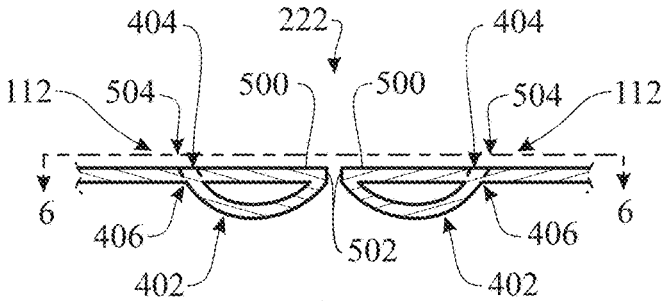
FIG. 5 presents a partial view of the pockets of FIG. 4, the partial view taken from sectional line 5-5 of FIG. 4.
Figure 6:
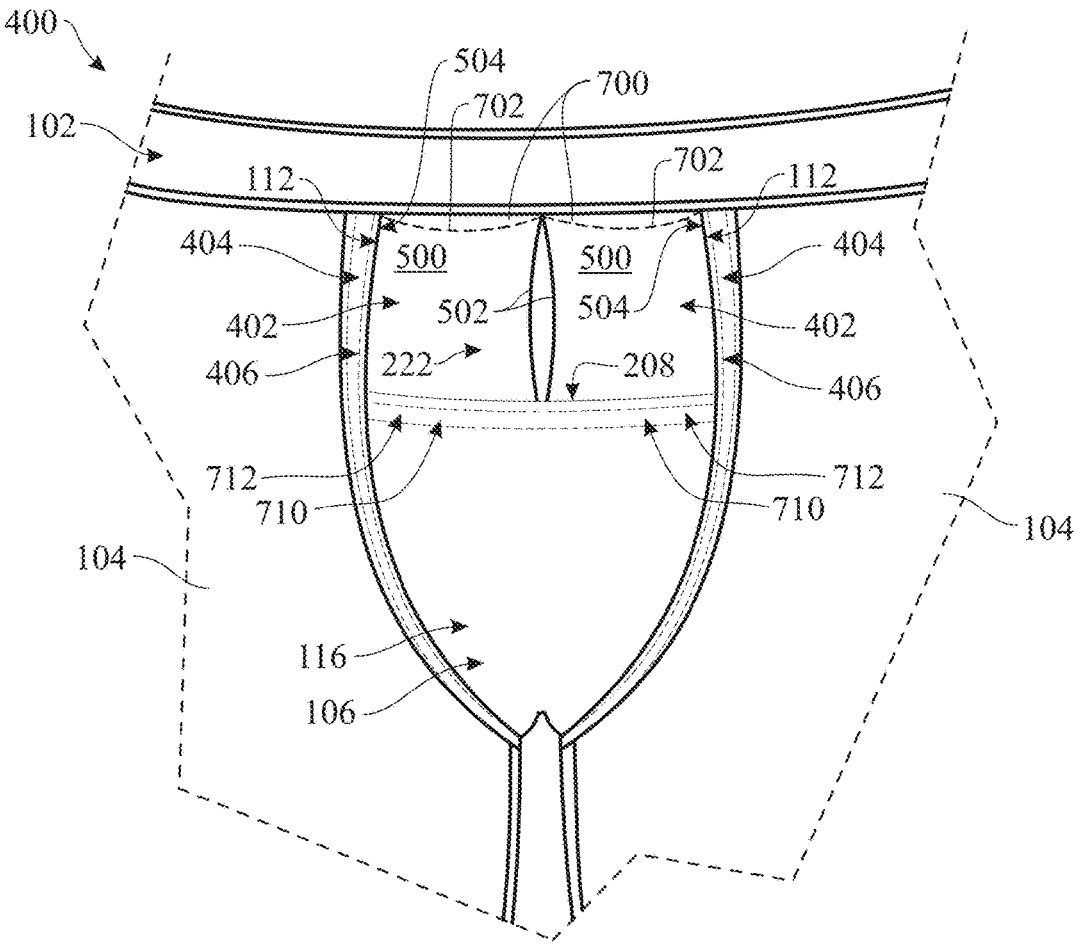
FIG. 6 presents a sectional view of an inside of the undergarment of FIG. 4 looking out, the section taken along sectional line 6-6 of FIG. 5.
Figure 7:
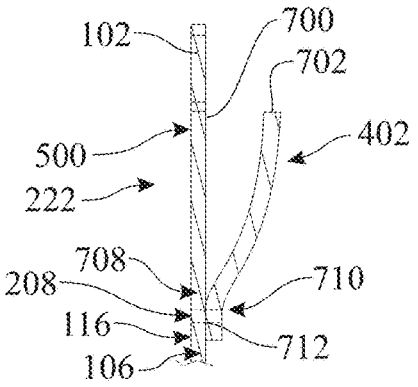
FIG. 7 presents a sectional view of a pocket of FIG. 4, the section taken along sectional line 7-7 of FIG. 4.

Turning for the moment to FIGS. 5 and 7, the pockets 402 each may have an inner wall 500 respectively, where the inner wall 500 has a too 700 that is affixed along a portion of the waistband 102, for each pocket 402 respectively. Each pocket 402 may be affixed along a portion of the bottom edge 208, for each pocket 402 respectively. For example, each pocket 402 may be affixed to the bottom edge 208 via stitching 712. The pockets 402 each may have an outer wall 706 such that the outer wall 706 is continuous with a medial side 502 (FIG. 5) of the inner wall 500, for each pocket 402 respectively. The outer wall 706 may be continuous and integrally formed with the inner wall 500 through the medial surfaces 502, for each pocket respectively. For example, the outer wall 706 and the inner wall 500 may be continuously integral with one another as part of a single piece of fabric that is folded at medial surfaces 502 for forming each pocket. Outer lateral sides 406 of the inner wall 500 and the outer wall 706 may be together affixed along lateral edges 112 of the opening 222 (FIGS. 4 and 5), for each pocket respectively. A bottom. 708 of the inner wall 500 and the outer wall 706 may be together affixed along a portion of the bottom edge 208 (FIG. 7), for each pocket respectively. A top 702 of the outer wall 706 may be detachably securable to a top 700 of the inner wall 500, for each pocket respectively (FIG. 7). The top 702 of the outer wall 706 may alternatively be detachably securable to the elastic waistband 102. The outer wall 706 may be detachably securable is hook and loop fasteners or buttons. As such, each pocket of pockets 402 may have an openable or open top 704 and a closed bottom 710 and closed sides 504 to receive and store items while the male organ is allowed to pass through the opening 222 and through between the medial surfaces 502 of the pockets 402 to protrude from the undergarment 400. In an open state where the outer wall 706 is detached from the inner wall 500, a space between top 702 of the outer wall 706 and top 700 of the inner wall 500 may receive items. Received items may be secured by securing the top 702 of the outer wall 706 to the top 700 of the inner wall 500. The together affixed portions of the inner and outer wall may cause the pocket to have the closed bottom 710 and the closed sides 504, for each pocket respectively. The inner wall 500 and the outer wall 706 of the pockets 402 may be together stichably affixed at the lateral edges 112 of the opening 222 and at the bottom edge 208 of the opening 222, for each pocket respectively.

It is to be understood that the above descriptions of the opening 222 with respect to the embodiment of FIGS. 1-3 may be appropriately applied to the embodiment of FIGS. 4-7. For example, in some embodiments where the above described upper crotch material (not shown) is affixed along the waistband 102, the top 700 of the inner wall 500 may be affixed to the upper crotch material (not shown).

It is to be understood that respective heights of each pocket 402 may be defined by a distance between the top 700 of the inner wall 500 and the bottom 708 of the inner wall 500 or the closed bottom 710. Alternatively, a height of each pocket 402 may be defined by a distance between the top 702 of the outer wall 706 and the bottom 708 of the inner wall 500 or the closed bottom 710. A width of each pocket 402 may be defined by a distance between opposing lateral sides 504 of each pocket 402. For example, the width of each pocket 402 may be defined by a distance between portions of the lateral sides 504 of each pocket 402 that are affixed to the undergarment 400 or the leg portions 104. The height of each pocket 402 may be greater than or equal to the height of the opening 222. The collective width of the pockets 402 may be greater, equal to, or less than the width of the opening 222. The width of each pocket 402 may be less than the width of the opening 222.

It is to be understood that the medial sides 502 do not require stitching. Each of the medial sides 502 may be formed by folding a sheet of fabric material into a tubular structure, and affixing the tubular structure at the bottom 710 and at a lateral side 504 of the tubular structure to affix both the inner and outer walls 500 and 706 to the undergarment 400, and by affixing the Inner wall 500 to the undergarment 400. This provides a pocket 402 with an open or openable top, without requiring stitching where the male member allowed to pass through at the medial sides 502.

It is to be understood that descriptions of like elements as described above with respect to FIGS. 1-3 also apply to FIGS. 4-7. For example, the crotch areas, the openings, and the waistbands may be analogous in the figures.

I claim:

1. An undergarment comprising:

an elastic waistband;

two leg portions attached to said elastic waistband;

a crotch area connecting said two leg portions to one another, said crotch area having an opening defining a passageway for allowing a male organ to pass through and protrude from said undergarment; and a double-walled pocket affixed externally at said crotch area, said double-walled pocket covering said opening.

2. The undergarment according to claim 1, wherein said double-walled pocket has lateral sides that are non-releasably affixed along lateral edges of said opening.

3. The undergarment according to claim 1, wherein said double-walled pocket has an inner wall, a top of said inner wall being affixed along a portion of said waistband.

4. The undergarment according to claim 1, wherein said opening has a bottom edge, said double-walled pocket overlapping said bottom edge.

5. The undergarment according to claim 4, wherein said bottom edge is elastic.

6. The undergarment according to claim 3, wherein said double-walled pocket has an outer wall, said outer wall being continuous with a bottom of said inner wall.

7. The undergarment according to claim 1, wherein said double-walled pocket has an outer wall, a top of said outer wall being detachably securable to a top of said inner wall.

8. The undergarment according to claim 1, wherein said double-walled pocket has an open top and a closed bottom and closed sides to receive and store items.

9. An undergarment comprising:

an elastic waistband;

two leg portions attached to said elastic waistband;

a crotch area connecting said two leg portions to one another, said crotch area having an opening defining a passageway for allowing a male organ to pass through and protrude from said undergarment; and a first double-walled pocket and a second double-walled pocket affixed externally at said crotch area allowing said male organ to pass through between said pockets.

10. The undergarment according to claim 9, wherein each pocket has an outer lateral side that is affixed along a lateral edge of said opening, for each pocket respectively.

11. The undergarment according to claim 9, wherein each pocket has an inner wall, a top of said inner wall being affixed along a portion of said waistband, for each pocket respectively.

12. The undergarment according to claim 9, wherein said opening has a bottom edge, each pocket being affixed along a portion of said bottom edge, for each pocket respectively.

13. The undergarment according to claim 9, wherein each pocket has an outer wall, said outer wall being continuous with a medial side of said inner wall, for each pocket respectively.

14. The undergarment according to claim 9, wherein each double-walled pocket has an outer wall, a top of said outer wall being detachably securable to a top of said inner wall, for each pocket respectively.

15. The undergarment according to claim 9, wherein each double walled pocket has an open top and a closed bottom and closed sides to receive and store items.

16. An undergarment comprising:

an elastic waistband;

two leg portions attached to said elastic waistband;

a crotch area connecting said two leg portions to one another, said crotch area having an opening defining a passageway for allowing a male organ to pass through and protrude from said undergarment;

a first double-walled pocket and a second double-walled pocket affixed externally at said crotch area allowing said male organ to pass through between medial surfaces of said pockets;

each pocket having an inner wall, a top of said inner wall being affixed along a portion of said waistband, for each pocket respectively;

each pocket having an outer wall, outer lateral sides of said inner wall and outer wall being together affixed along lateral edges of said opening, for each pocket respectively;

said opening having a bottom edge, a bottom of said inner and outer wall being together affixed along a portion of said bottom edge, for each pocket respectively; and said outer wall being continuous and integrally formed with said inner wall through said medial surfaces, for each pocket respectively.

17. The undergarment according to claim 16, wherein a top of said outer wall is detachably securable to a top of said inner wall, for each pocket respectively.

18. The undergarment according to claim 16, wherein said together affixed portions of said inner and outer wall cause said pocket to have a closed bottom and closed sides to hold and store items.

19. The undergarment according to claim 16, wherein said inner and outer walls of said pockets are together stitchably affixed at said lateral edges of said opening and at said bottom edge of said opening, for each pocket respectively.

20. The undergarment according to claim 16, wherein a top of said outer wall is detachably securable to a top of said inner wall via hook and loop fasteners.

* * * * *